US012281403B2

(12) United States Patent
Zhang et al.

(10) Patent No.: US 12,281,403 B2
(45) Date of Patent: Apr. 22, 2025

(54) METHOD FOR ELECTROPLATING NANOGRAINED COPPER

(71) Applicant: UMICORE SUZHOU SEMICONDUCTOR MATERIALS CO., LTD., Suzhou (CN)

(72) Inventors: Yun Zhang, Suzhou (CN); Peipei Dong, Suzhou (CN); Jing Wang, Suzhou (CN)

(73) Assignee: UMICORE SUZHOU SEMICONDUCTOR MATERIALS CO., LTD., Jiangsu (CN)

( * ) Notice: Subject to any disclaimer, the term of this patent is extended or adjusted under 35 U.S.C. 154(b) by 0 days.

(21) Appl. No.: 17/750,790

(22) Filed: May 23, 2022

(65) Prior Publication Data

US 2023/0257896 A1 Aug. 17, 2023

Related U.S. Application Data

(63) Continuation of application No. PCT/CN2022/076055, filed on Feb. 11, 2022.

(51) Int. Cl.

| | |
|---|---|
| ***C25D 3/38*** | (2006.01) |
| ***C25D 5/00*** | (2006.01) |
| ***C25D 5/08*** | (2006.01) |
| ***C25D 5/48*** | (2006.01) |

(Continued)

(52) U.S. Cl.

CPC ..... *C25D 3/38* (2013.01); *C25D 5/48* (2013.01); *C25D 5/50* (2013.01); *C25D 5/605* (2020.08); *C25D 5/615* (2020.08); *C25D 21/10* (2013.01)

(58) Field of Classification Search

CPC ... C25D 3/38; C25D 5/08; C25D 5/50; C25D 5/60; C25D 5/605

(Continued)

(56) References Cited

U.S. PATENT DOCUMENTS 4,036,710 A * 7/1977 Kardos ..... C25D 3/38 205/296
6,776,893 B1 * 8/2004 Too ..... C25D 3/38 205/296

(Continued)

FOREIGN PATENT DOCUMENTS

CN 103924268 A 7/2014
EP 3470552 A1 * 4/2019 ..... C08G 65/2606

(Continued)

OTHER PUBLICATIONS

Koo et al., "Copper Electroless Bonding of Dome-Shaped Pillars for Chip-to-Package Interconnect," Journal of The Electrochemical Society (Oct. 3, 20111), vol. 158, No. 12, pp. D698-D703. (Year: 2011).*

(Continued)

*Primary Examiner* — Edna Wong
(74) *Attorney, Agent, or Firm* — SZDC Law PC

(57) ABSTRACT

A method of electroplating nanograined copper on a substrate includes: providing the substrate; providing an electroplating bath that includes a copper salt, an acid, a leveler, a chlorine compound, an accelerator, a suppressor; and water; and electroplating the substrate in the electroplating bath to form the nanograined copper at room temperature. The suppressor is a ployether polyol compound, the nanograined copper has an average grain size of about 100 nm, and the nanograined copper has a resistivity of about 1.78-1.90 μOhm·cm. A nanograined copper prepared according to the method is also disclosed.

7 Claims, 10 Drawing Sheets

(51) Int. Cl.
*C25D 5/50* (2006.01)
*C25D 21/10* (2006.01)

(58) Field of Classification Search
USPC ..... 205/123, 125, 296, 111, 148, 224
See application file for complete search history.

(56) References Cited

U.S. PATENT DOCUMENTS

| | | | | |
|---|---|---|---|---|
| 2005/0274622 | A1 | 12/2005 | Sun et al. | |
| 2015/0368819 | A1* | 12/2015 | Zhang | C25D 3/56 516/200 |
| 2018/0355502 | A1* | 12/2018 | Najjar | H01L 24/13 |
| 2022/0064813 | A1* | 3/2022 | Zhang | H05K 3/241 |

FOREIGN PATENT DOCUMENTS

| | | | |
|---|---|---|---|
| KR | 20180071256 | A | 6/2018 |
| KR | 20190052629 | A | 5/2019 |
| WO | 2015096347 | A1 | 7/2015 |

OTHER PUBLICATIONS

Tummala et al., "Copper Interconnections for High Performance and Fine Pitch Flip Chip Digital Applications and Ultra-Miniaturized RF Module Applications," 56th Electronic Components and Technology Conference (May 3, 20060), pp. 102-111. (Year: 2006).*

* cited by examiner (a)

(b)

(a)

(b)

(a)

(b)

(a)

(b)

(a)

(b)

(c)

(a)

(b)

(a)

(b)

METHOD FOR ELECTROPLATING NANOGRAINED COPPER

This application is a continuation application of PCT/CN2022/076055, filed on Feb. 11, 2022, which is incorporated by reference for all purposes as if fully set forth herein.

FIELD OF THE INVENTION

The present invention relates to a method of electroplating nanograined electroplated copper (nanograined copper) and the nanograined copper prepared by the method.

BACKGROUND OF THE INVENTION

Copper is used ubiquitously in the electronics industry as an electrical and thermal conductor. It is found in almost all electrical devices today and serves the function for electrical conductivity or as a heat sink to take away heat that is generated from the heat generating sources such as CPUs. In today's microelectronics manufacturing, electroplating is a method of choice to make thin or thick copper films inside various semiconductor and conductor devices. This is especially true for PCB and wafer plating, where copper is electrodeposited onto a PCB board or onto a wafer. In recent years, copper is plated onto a "reconstituted wafer" in so called fan-out wafer level packaging (FOWLP) or it is plated onto large substrate panels in so called fan-out panel level packaging (FOPLP). Regardless of what is the application, it is desirable that the plated copper has as low as resistivity as the IACS high conductivity copper; has a microstructure that does not undergo recrystallization or self-anneal at room temperature. In addition, for copper-to-copper hybrid bonding, it is desirable that the bonding temperature is as low as possible.

Optimization of the electroplated copper requires high deposit purity, low annealing temperatures, and proper growth of the grains over the bonding interface. Electroplated copper usually results in crystalline grains first, followed by growth of the grains to the final microstructure. The deposit properties that determine the extent to which this growth occurs, the corresponding timeframe, and the required temperature depend on the deposition process.

Currently, there are no commercially viable methods available to produce nanograined copper. There is a need for a method of making nanograined copper under typical manufacturing process conditions and stay unchanged after the subsequent steps and the nanograined copper produced by the method.

It is important to point out that the acid copper plating process and the method of producing nanograined copper are not limited to FOWLP and FOPLP, it is applicable to situations that a thick copper film needs to be generated on any substrates such as silicon, PCB, glass, ceramic, metals or composite structures made among them.

SUMMARY OF THE INVENTION

It is to be understood that both the foregoing general description and the following detailed description are exemplary and explanatory and are intended to provide further explanation of the invention as claimed.

In one embodiment, the present application provides a method of electroplating nanograined copper on a substrate. The method includes: providing the substrate; providing an electroplating bath that includes a copper salt, an acid, a leveler, a chlorine compound, an accelerator, a suppressor;

and water; and electroplating the substrate in the electroplating bath to form the nanograined copper at room temperature. The suppressor is a polyether polyol compound, the nanograined copper has an average grain size of about 100 nm, and the nanograined copper has a resistivity of about 1.78-1.90 μOhm·cm.

In another embodiment, the polyether polyol compound has the following structure:

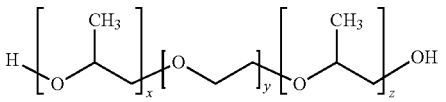

x, y and z are independently an integer of 1-35, preferably, an integer of 2-15.

In another embodiment, the accelerator is selected from the group consisting of bis-(sulfobutyl)-disulfide, bis-(sulfo-1-methylpropyl)-disulfide, bis-(sulfopropyl)-disulfide, and alkali metal salts thereof.

In another embodiment, the leveler is selected from the group consisting of

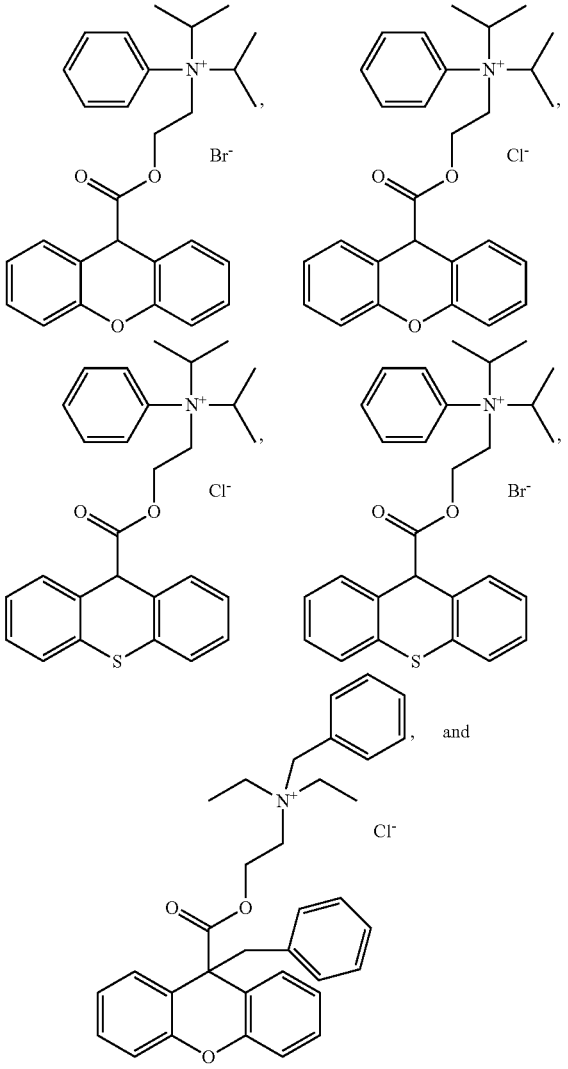

-continued

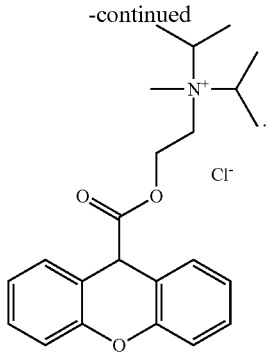

In another embodiment, the method further includes annealing the nanograined copper at room temperature for 1-7 days. The average grain size of the nanograined copper remains at about 100 nm and the resistivity of the nanograined copper remains at about 1.78-1.90 μOhm·cm.

In another embodiment, the method further includes annealing the nanograined copper at 100-140° C. for 1-3 hours. The average grain size of the nanograined copper increases to about 700 nm and the resistivity of the nanograined copper remains at about 1.78-1.90 μOhm·cm.

In another embodiment, the method further includes annealing the nanograined copper at 190-210° C. for 0.5-2 hours. The average grain size of the nanograined copper increases to about 800 nm and the resistivity of the nanograined copper remains at about 1.78-1.90 μOhm·cm.

In another embodiment, the electroplating at 20 to 22° C.

In another embodiment, the electroplating is conducted at a current density of 1-25 A/dm$^2$; at a current density of 2 A/dm$^2$; or at a current density of 5 A/dm$^2$.

In another embodiment, the copper salt is copper sulfate and has a $Cu^{2+}$ concentration of 25-75 g/L; the acid is sulfuric acid and has a concentration of 75-125 g/L; the chlorine compound is hydrochloride and has a Cl- concentration of 25-75 ppm; the accelerator has a concentration of 5-10 mL/L; and the suppressor has a concentration of 5-15 mL/L; and leveler has a concentration of 10-20 mL/L.

In another embodiment, the method further includes stirring the electroplating bath at an agitation of 100-400 rpm while electroplating the substrate in the electroplating bath to form the nanograined copper; preferably, at an agitation of 150-300 rpm; and more preferably, at an agitation of 200 rpm.

In another embodiment, electroplating the substrate includes electroplating copper pillars.

In another embodiment, electroplating the substrate includes electroplating micro-bumps.

In another embodiment, electroplating the substrate includes electroplating RDLs (redistribution layer).

In another embodiment, electroplating the substrate includes electroplating via plus RDLs.

In another embodiment, the present application provides a nanograined copper prepared according to the method of the present application.

In another embodiment, the nanograined copper has a resistivity of 1.78-1.90 μOhm·cm as plated.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
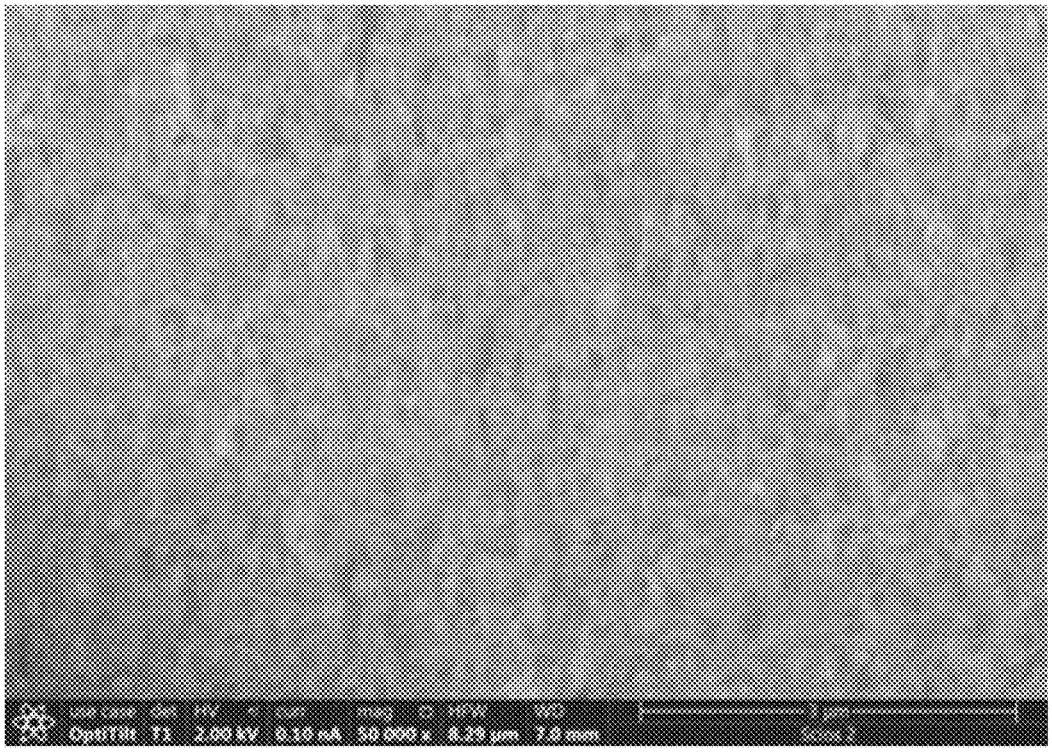
FIG. 1 shows the microstructure of the nanograined copper of Example 1 obtained after electroplating at 5 A/dm$^2$ (ASD): (a) cross-sectional SEM photo and (b) EBSD photo.
Figure 1:
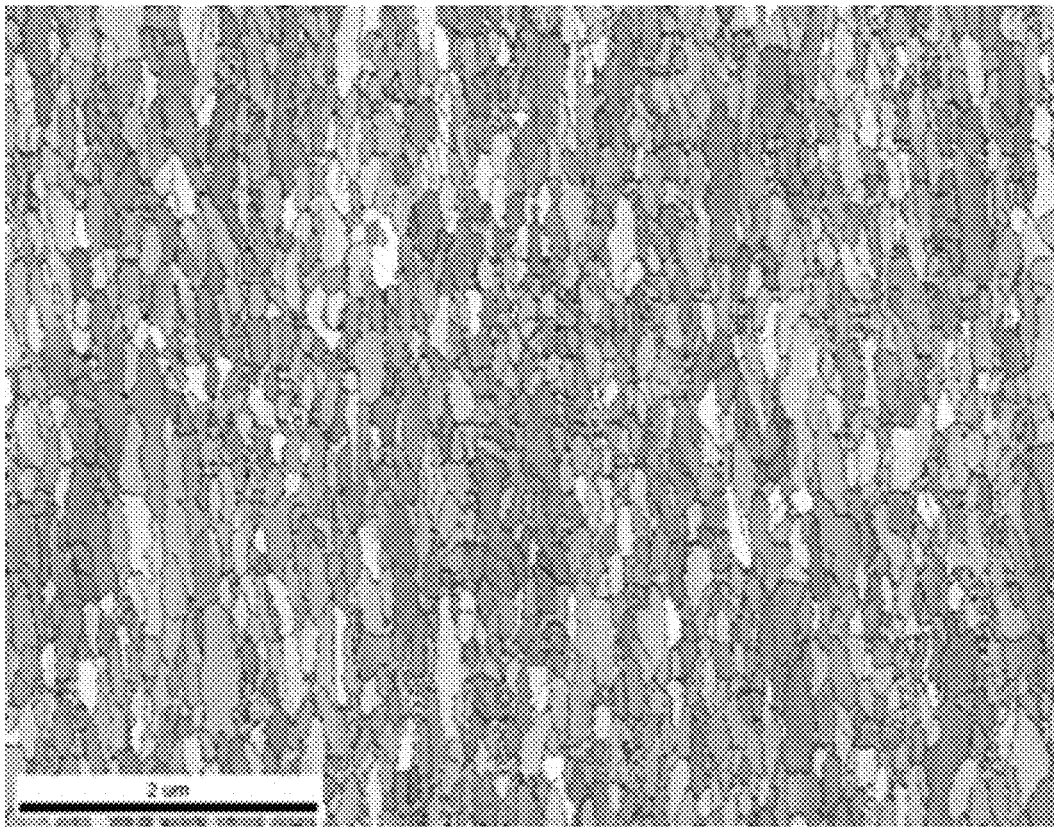

Reference will now be made in detail to embodiments of the present invention, example of which is illustrated in the accompanying drawings.

This invention discloses a copper electroplating bath that contains certain additives and a method of producing nanograined copper with the copper electroplating bath.

In one embodiment, an electroplating bath composition contains a copper salt, an acid, a chloride compound, an accelerator, a leveler and a suppressor.

The copper salt can be copper sulfate and the acid can be sulfuric acid. The concentration of copper ion and acid may vary over wide limits; for example, from about 4 to 70 g/L copper and from about 2 to about 225 g/L sulfuric acid. In this regard the methods of the invention are suitable for use in distinct acid/copper concentration ranges, such as high acid/low copper systems, in low acid/high copper systems, and mid acid/high copper systems. In high acid/low copper systems, the copper ion concentration can be on the order of 4 g/L to on the order of 30 g/L; and the acid concentration may be sulfuric acid in an amount greater than about 100 g/L up to 225 g/L. In exemplary high acid low copper system, the copper ion concentration is about 17 g/L, where the sulfuric acid concentration is about 180 g/L. In some low acid/high copper systems, the copper ion concentration can be between 35 g/L to about 65 g/L, such as between 38 g/L and about 50 g/L. 35 g/L copper ion corresponds to about 140 g/L $CuSO_4.5H_2O$, copper sulfate pentahydrate. In some low acid high copper systems, the copper ion concentration can be between 30 to 60 g/L, such as between 40 g/L to about 50 g/L. The acid concentration in these systems is preferably less than about 100 g/L.

In other embodiments, the copper source can be copper methane sulfonate and the acid can be methane sulfonic acid. The use of copper methane sulfonate as the copper source allows for greater concentrations of copper ions in the electrolytic copper deposition chemistries in comparison to other copper ion sources. Accordingly, the source of copper ion may be added to achieve copper ion concentrations greater than about 80 g/L, greater than about 90 g/L, or even greater than about 100 g/L, such as, for example about 110 g/L. Preferably, the copper methane sulfonate is added to achieve a copper ion concentration between about 30 g/L to about 100 g/L, such as between about 40 g/L and about 60 g/L. High copper concentrations enabled by the used of copper methane sulfonate is thought to be one method for alleviating the mass transfer problem, i.e., local depletion of copper ions particularly at the bottom of deep features. High copper concentrations in the bulk solution contribute to a step copper concentration gradient that enhances diffusion of copper into the features.

When copper methane sulfonate is used, it is preferred to use methane sulfonic acid for acid pH adjustment. This avoids the introduction of unnecessary anions into the electrolytic deposition chemistry. When methane sulfonic acid is added, its concentration may be between about 1 ml/L to about 400 ml/L.

Chloride ion or bromide ion may also be used in the bath at a level up to about 200 mg/L (about 200 ppm), preferably from about 10 mg/L to about 90 mg/L (about 10 to 90 ppm), such as about 50 mg/L (about 50 ppm). Chloride ion or bromide ion is added in these concentration ranges to enhance the function of other bath additives. In particular, it has been discovered that the addition of chloride ion or bromide ion enhances the effectiveness of a leveler. Chloride ions are added using HCl. Bromide ions are added using HBr.

A large variety of additives may typically be used in the bath to provide desired surface finishes and metallurgies for the plated copper metal. Usually more than one additive is used to achieve desired functions. At least two or three additives are generally used to initiate good copper deposition as well as to produce desirable surface morphology with good conformal plating characteristics. Additional additives (usually organic additives) include wetter, grain refiners and secondary brighteners and polarizers for the suppression of dendritic growth, improved uniformity and defect reduction.

In some embodiments, the accelerator is selected from the group consisting of bis-(sulfobutyl)-disulfide (A1), bis-(sulfo-1-methylpropyl)-disulfide (A2), bis-(sulfopropyl)-disulfide (A3), and alkali metal salts thereof. The accelerator has a concentration of 5-10 mL/L, preferably, 4 mL/L.

In some embodiments, the suppressor is a polyether polyol compound. Preferably, the polyether polyol compound has the following structure:

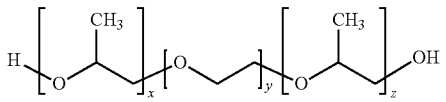

x, y and z are independently an integer of 1-35. Preferably, x, y and z are independently an integer of 2-15, and the polyether polyol compound has a molecular weight of about 2,000 (suppressor: S1). The suppressor has a concentration of 5-15 mL/L, preferably, 10 mL/L.

In some embodiments, the leveler is selected from the group consisting of (L1)

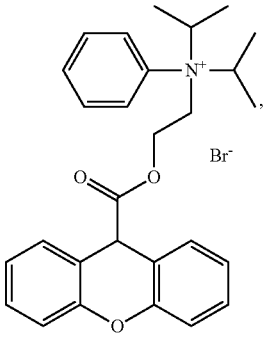

(L2)

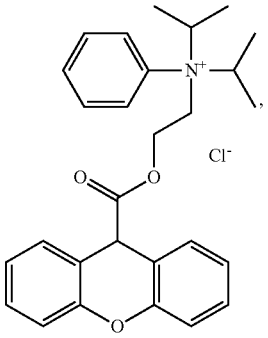

(L3)

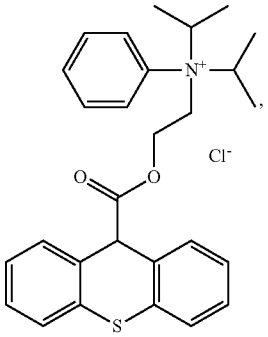

(L4)

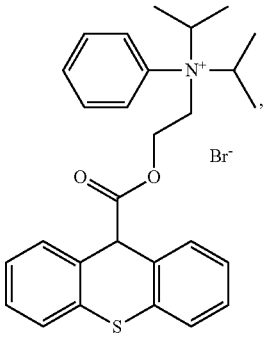

-continued (L5)

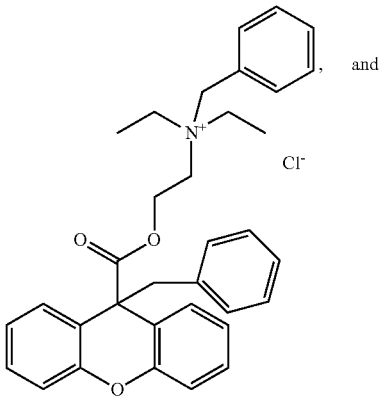

and (L6)

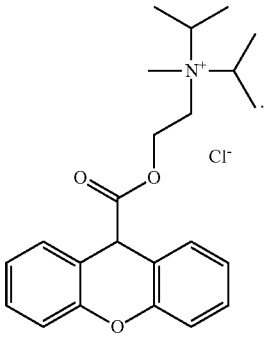

The leveler has a concentration of 10-20 mL/L, preferably, 15 mL/L.

Plating equipment for electroplating semiconductor substrates is well known. Electroplating equipment includes an electroplating tank which holds an electroplating bath and which is made of a suitable material such as plastic or other material inert to the electroplating bath. The tank may be cylindrical, especially for wafer plating. A cathode is horizontally disposed at the upper part of the tank and may be any type of substrate such as a silicon wafer having openings such as lines and vias. The wafer substrate is typically coated first with barrier layer, which may be titanium nitride, tantalum, tantalum nitride, or ruthenium to inhibit copper diffusion, and next with a seed layer of copper or other metal to initiate copper electrodeposition. A copper seed layer may be applied by chemical vapor deposition (CVD), physical vapor deposition (PVD), or the like. The copper seed layer may also be electroless copper. An anode is also preferably circular for wafer plating and is horizontally disposed at the lower part of tank forming a space between the anode and the cathode. The anode is typically a soluble anode such as copper metal. It could also be insoluble anode or dimensional stable anode. For panel plating, the anode is preferably of a rectangular shape. The anode can be a soluble one or an insoluble one.

The electroplating bath additives can be used in combination with membrane technology being developed by various plating tool manufacturers. In this system, the anode may be isolated from the organic bath additives by a membrane. The purpose of the separation of the anode and the organic bath additives is to minimize the oxidation of the organic bath additives on the anode surface.

In some embodiment, the electroplating bath can be used as a "drop-in" replacement of existing copper plating baths.

The cathode substrate and anode are electrically connected by wiring and, respectively, to a rectifier (power supply). The cathode substrate for direct or pulse current has a net negative charge so that copper ions in the solution are reduced at the cathode substrate forming plated copper metal on the cathode surface. An oxidation reaction takes place at the anode. The cathode and anode may be horizontally or vertically disposed in the tank.

During operation of the electroplating bath, a pulse current, direct current, reverse periodic current, or other suitable current may be employed. The temperature of the electroplating bath can be maintained using a heater/cooler whereby electroplating bath is removed from the holding tank and flows through the heater/cooler and it is recycled to the holding tank.

In some embodiments, the electroplating can be conducted at room temperature. In the present application, room temperature is 15-25° C., preferably 20-22° C.

The electrical current density can be from 1 A/dm$^2$ (ASD) to 25 A/dm$^2$; preferably from 2 A/dm$^2$ to 5 A/dm$^2$; and more preferably, 2 A/dm$^2$ or 5 A/dm$^2$. It is preferred to use an anode to cathode ratio of 1:1, but this may also vary widely from about 1:4 to about 4:1. The process also uses mixing in the electrolytic plating tank which may be supplied by agitation or preferably by the circulating flow of recycle electrolytic solution through the tank.

In some embodiments, the electroplating can be conducted on various substrates such as glass, organic polymer, silicon, ceramics, and metals.

After electroplating, the nanograined copper can be annealed at temperatures room temperature for 1-7 days (self-annealing). The nanograined copper can also be annealed at 100-140° C. for 1-3 hours, preferably, at 120° C., for 2 hours; at 190-210° C. for 0.5-2 hours, preferably, at 200° C. for 1 hour; or at 230-250° C. for 0.5-2 hours, preferably, at 250° C. for 0.5 hour.

In some embodiments, the nanograined copper has an average grain size of about 100 nm and a resistivity of about 1.78-1.90 μOhm·cm. After self-annealing, the average grain size of the nanograined copper remains at about 100 nm and the resistivity of the nanograined copper remains at about 1.78-1.90 μOhm·cm. After being annealed at 100-140° C. for 1-3 hours, the average grain size of the nanograined copper increases to about 700 nm and the resistivity of the nanograined copper remains at about 1.78-1.90 μOhm·cm. After being annealed at 190-210° C. for 0.5-2 hours (e.g., 200° C. for 1 hour), the average grain size of the nanograined copper increases to about 800 nm and the resistivity of the nanograined copper remains at about 1.78-1.90 μOhm·cm. After being annealed at 230-250° C. for 0.5-1 hour (e.g., 250° C. for 0.5 hour), the average grain size of the nanograined copper increases significantly to more than 2,000 nm (e.g., 2,250 nm). The term "about" means in the range of +20% to -20% of a value, +10% to −10% of the value, or +5% to −5% of the value.

In some embodiments, the grain size and resistivity of the nanograined copper are measured as plated; are measured after annealing at room temperature; or are measured after annealing at 100-140° C. for 1-3 hours; at 190-210° C. for 0.5-2 hours; or at 230-250° C. for 0.5-1 hour.

In some embodiment, the electroplating bath is stirred at an agitation of 100-400 rpm while electroplating the substrate in the electroplating bath to form the nanograined copper; preferably, at an agitation of 150-300 rpm; and more preferably, at an agitation of 200 rpm.

EXAMPLES

The following non-limiting examples are provided to further illustrate the present invention. While the leveler of present invention can be used in electroplating of metals such as copper, tin, nickel, zinc, silver, gold, palladium, platinum, and iridium, only electrolytic copper plating chemistries are described below.

Example 1

An electrolytic copper plating composition of the invention was prepared having the following components and concentrations:

The electrolytic copper deposition chemistry and plating conditions were prepared according to the instructions of Table 1 for example 1.

TABLE 1

| | | Unit | Value |
|---|---|---|---|
| VMS | $Cu^{2+}$ | g/L | 50 |
| | $H_2SO_4$ | g/L | 100 |
| | $Cl^-$ | ppm | 50 |
| Additives | Accelerator (A1) | mL/L | 4 |
| | Suppressor (S1) | mL/L | 10 |
| | Leveler (L1) | mL/L | 15 |
| Plating condition | CD | ASD | 5 or 2 |
| | Plating Height | um | 40 |
| | Agitation | rpm | 200 |
| | Temperature | ° C. | RT |

Substrate: blank wafer

The chlorine compound is hydrochloric acid. The suppressor is S1. The accelerator is A1. The leveler is L1.

After electroplating, the hardness was measured by a micro indenter method. The conditions are as follows: Vickers force: 01 kp; Dwell Time: 10 s. The results are shown in

TABLE 2

Resistivity was measured by a four-point probe method. The conditions are as follows: Type Keithley 2400 Source Meter. The results are also shown in Table 2.

| 5 ASD | Hardness (HV.01) | Resistivity (μOhm · cm) Pure copper: 1.72 |
|---|---|---|
| As plated | 207.8 | 1.787 |
| 120° C.@2 h anneal | 201.7 | 1.780 |
| 200° C.@1 h anneal | 186.2 | 1.806 |
| 250° C.@0.5 h anneal | 144.4 | 1.801 |

For the hardness, as plated >120° C. @ 2 h anneal>200° C. @ 1 h anneal>250° C. @ 0.5 h anneal. For the resistivity, there is no obvious difference between as plated condition and after anneal (at 120° C., 200° C., 250° C.).

Figure 2:
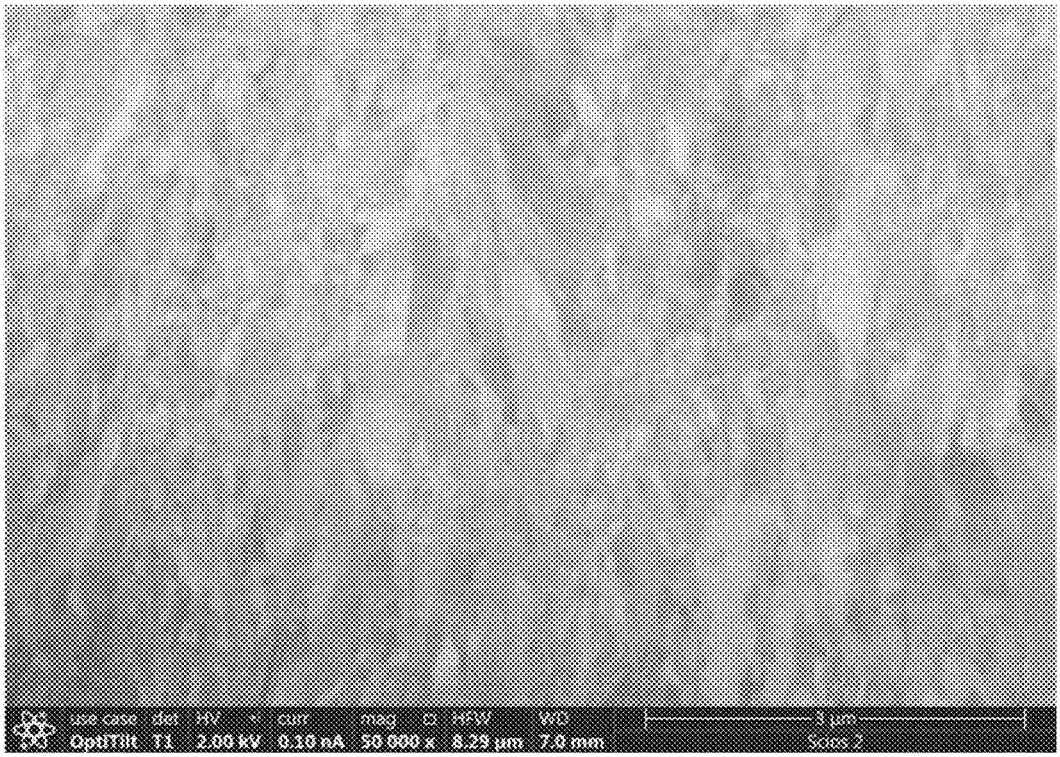
FIG. 2 shows the microstructure of the nanograined copper of Example 1 after (electroplated at 5 ASD) being annealed at 120° C. for 2 hours: (a) cross-sectional SEM photo and (b) EBSD photo.
Figure 2:
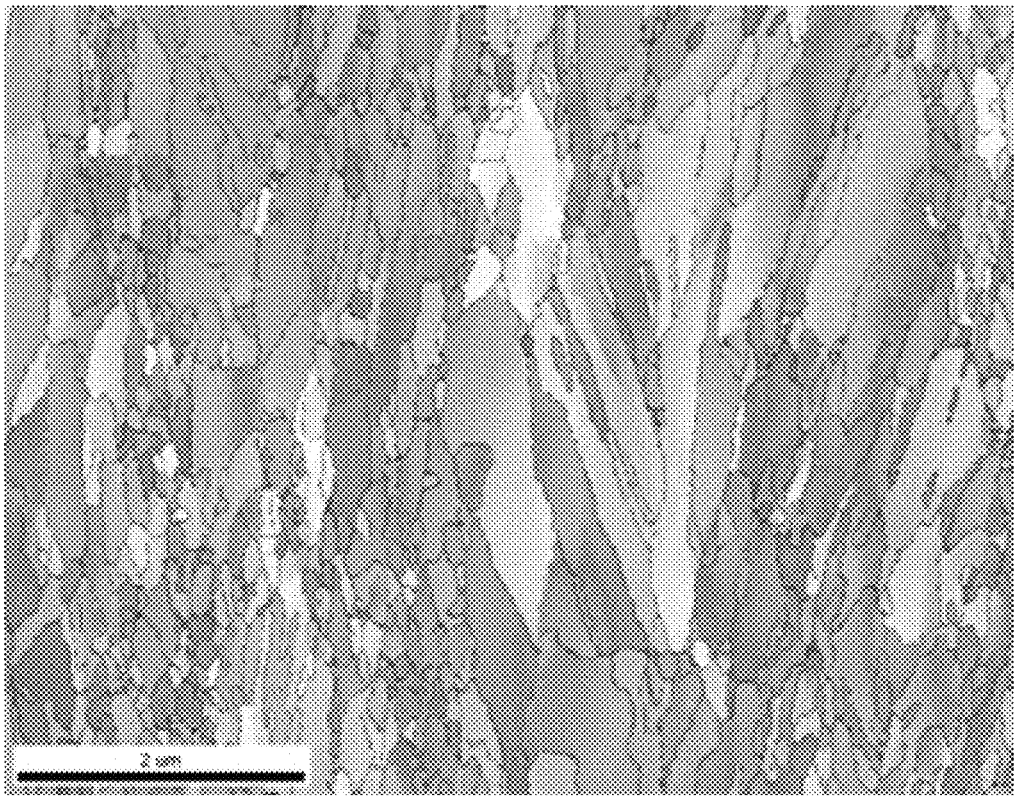

The morphology of the nanograined copper of Example 1 (electroplated at 5 A/dm$^2$) was measured after electroplating (as plated) and after being annealed at 120° C. for 2 hours, and is shown in FIGS. 1 and 2.

Figure 3:
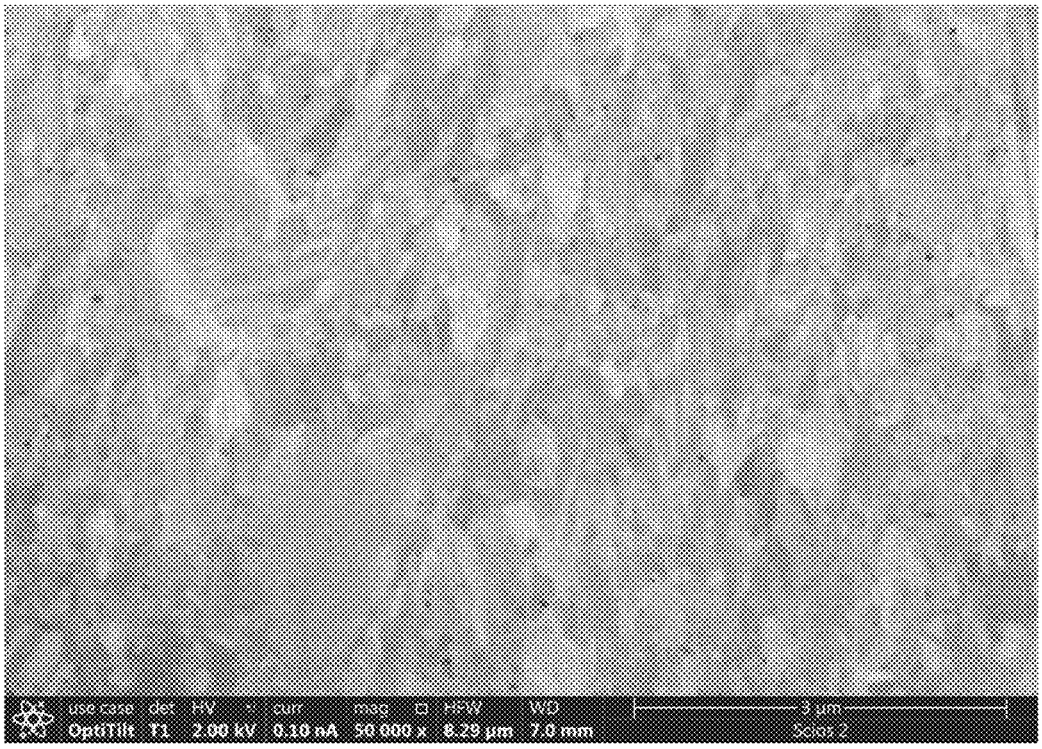
FIG. 3 shows the microstructure of the nanograined copper of Example 1 (electroplated at 5 ASD) measured after being annealed at 200° C. for 2 hours: (a) cross-sectional SEM photo and (b) EBSD photo.
Figure 3:
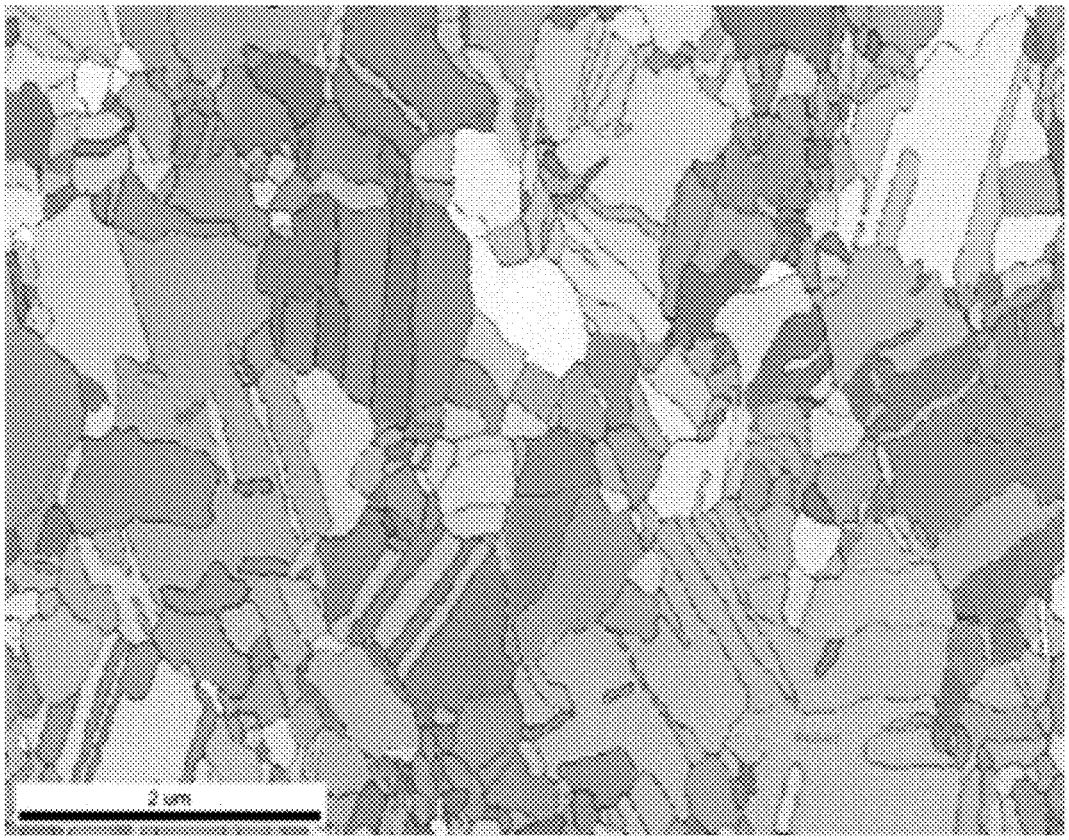
Figure 4:
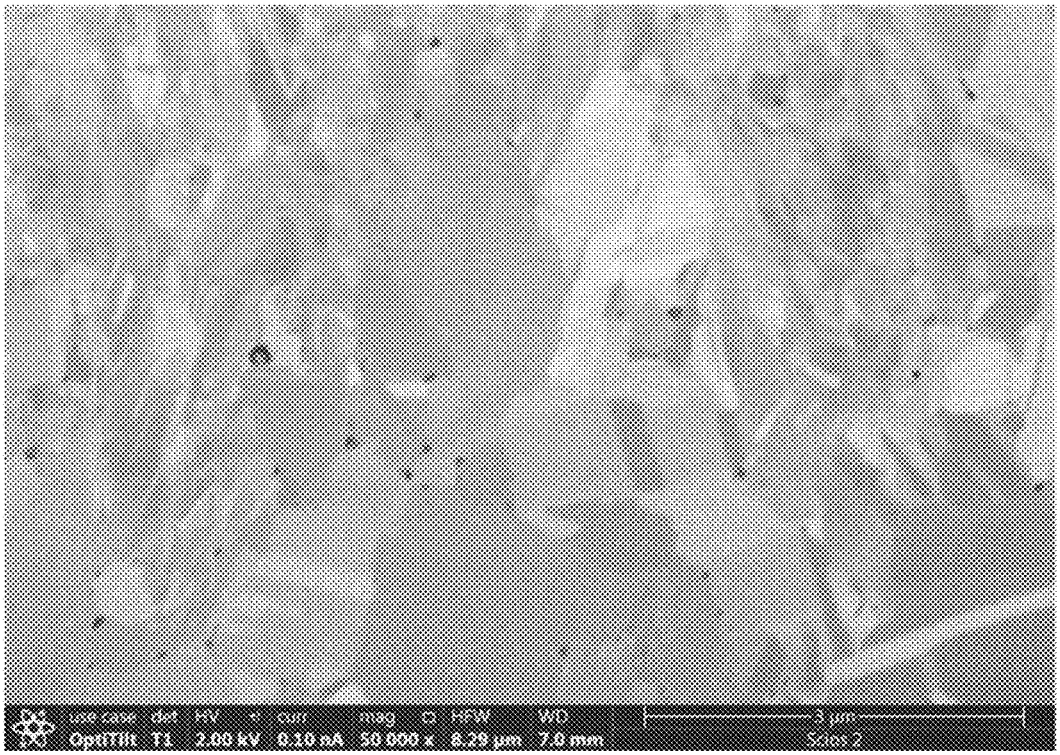
FIG. 4 shows the microstructure of the nanograined copper of Example 1 (electroplated at 5 ASD) after being annealed 240° C. for 2 hours: (a) cross-section SEM photo and (b) EBSD photo.
Figure 4:
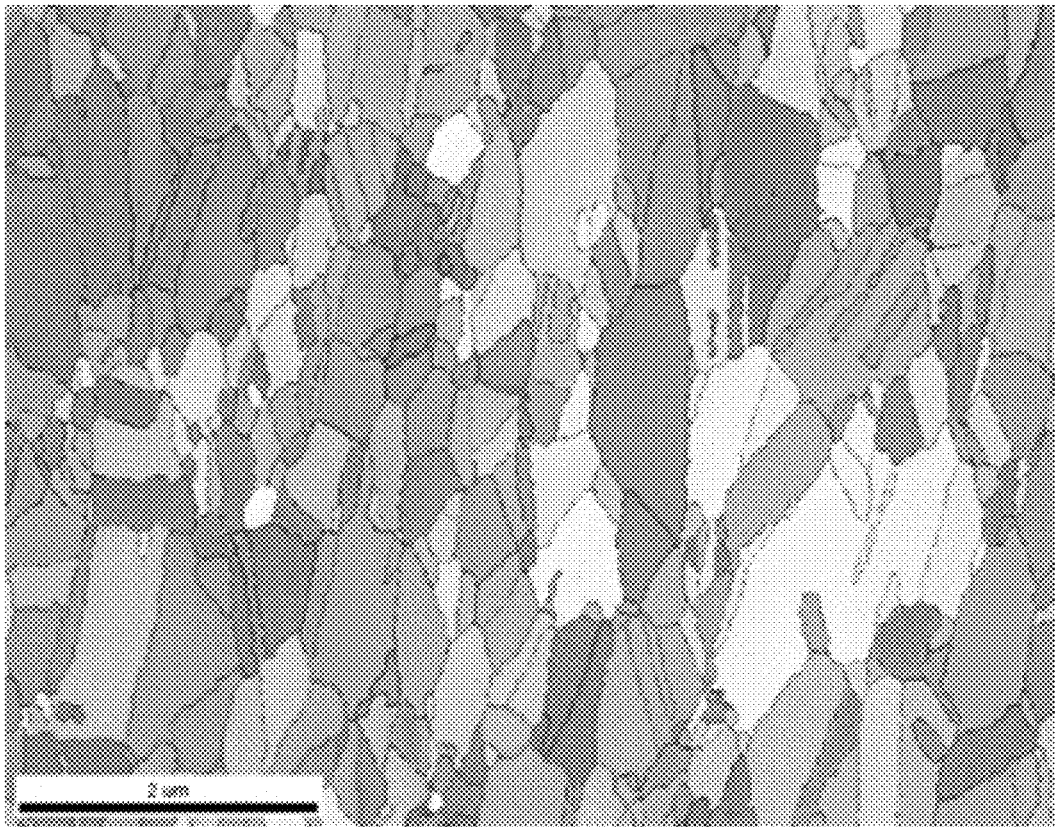

The morphology of the nanograined copper of Example 1 (electroplated at 5 A/dm$^2$) was also measured after being annealed at 200° C. for 1 hour and after being annealed 250° C. for 0.5 hour, and is shown in FIGS. 3 and 4.

As shown in FIGS. 1-4, for 5 ASD, grain size became bigger as the anneal temperature increased. Specially, when the anneal temperature was 250° C., the grain size significantly increased. The results are shown in Table 3.

TABLE 3

| 5 ASD | Grain size (nm) (average) |
|---|---|
| As plated | 107 |
| 120° C.@2 h anneal | 715 |
| 200° C.@1 h anneal | 735 |
| 250° C.@0.5 h anneal | 2250 |

Figure 5:
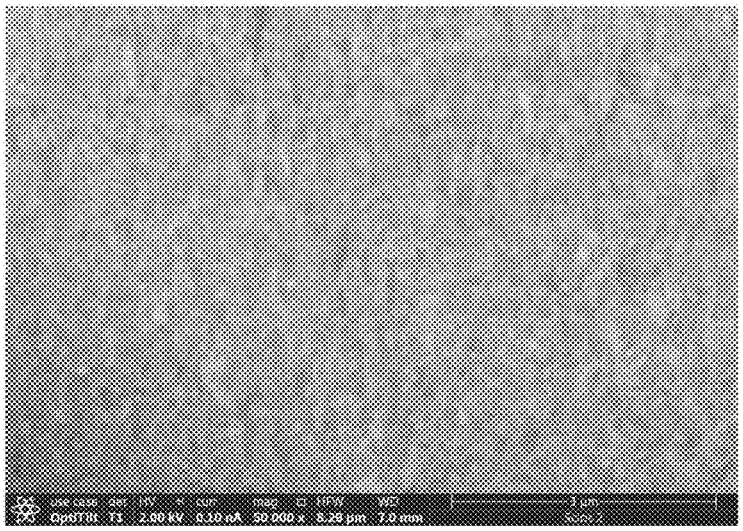
FIG. 5 shows the microstructure of the nanograined copper of Example 1 (electroplated at 5 ASD): (a) after 24 hours, (b) after 48 hours, and (c) after 168 hours.
Figure 5:
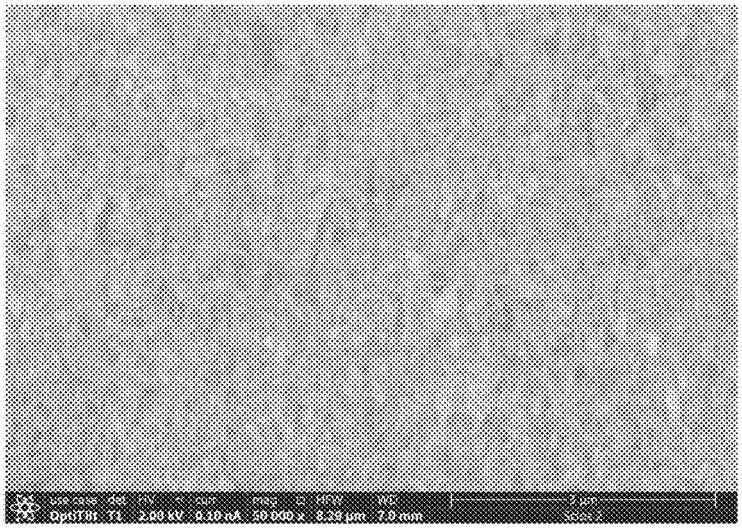
Figure 5:
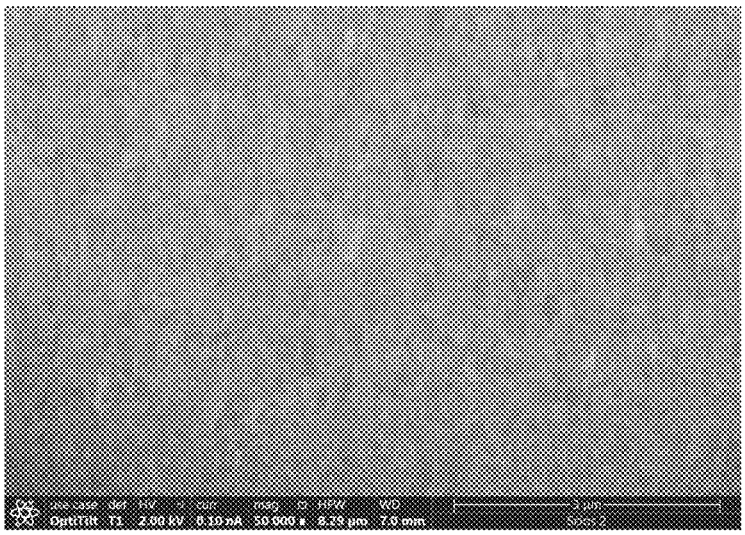

The morphology of the nanograined copper of Example 1 (electroplated at 5 A/dm$^2$) was measured after electroplating (as plated), after being annealed at room temperature for 2 days, and after being annealed at room temperature for 7 days, and is shown in FIG. 5.

The grain size of the nanograined copper (electroplated at 5 A/dm$^2$) was measured by an estimation method. The conditions are as follows: measuring the size of 20 grains from the EBSD and calculating the average. The results are shown in Table 4.

TABLE 4

| 5 ASD | Grain size (nm) (average) |
|---|---|
| As plated | 107 |
| self-anneal 2 days | 106 |
| self-anneal 7 days | 105 |

Grain size: for 5 ASD, the grain size does not change from as plated to self-anneal 7 days. The grain size at 5 ASD plating condition is around 100 nm.

Examples 2-8

Electroplating was conducted under the same conditions as Example 1 except that the suppressor, the accelerator, and/or the leveler was different. The details and results are shown in Table 5.

TABLE 5

| Examples | Suppressor | Accelerator | Leveler | Grain size (as plated) | Grain size (120° C. for 2 h) | Grain size (200° C. for 1 h) | Resistivity |
|---|---|---|---|---|---|---|---|
| 2 | S1 | A1 | L2 | 150 nm | 500 nm | 600 nm | 1.88 μOhm · cm |
| 3 | S1 | A2 | L2 | 120 nm | 800 nm | 860 nm | 1.78 μOhm · cm |
| 4 | S1 | A3 | L2 | 110 nm | 700 nm | 750 nm | 1.88 μOhm · cm |
| 5 | S1 | A1 | L3 | 108 nm | 700 nm | 800 nm | 1.86 μOhm · cm |
| 6 | S1 | A2 | L4 | 105 nm | 500 nm | 570 nm | 1.78 μOhm · cm |
| 7 | S1 | A3 | L5 | 120 nm | 700 nm | 800 nm | 1.87 μOhm · cm |
| 8 | S1 | A1 | L6 | 100 nm | 800 nm | 860 nm | 1.82 μOhm · cm |

The microstructures of the electroplated copper of Examples 2-8 are similar to the microstructure of Example 1.

Figure 9:
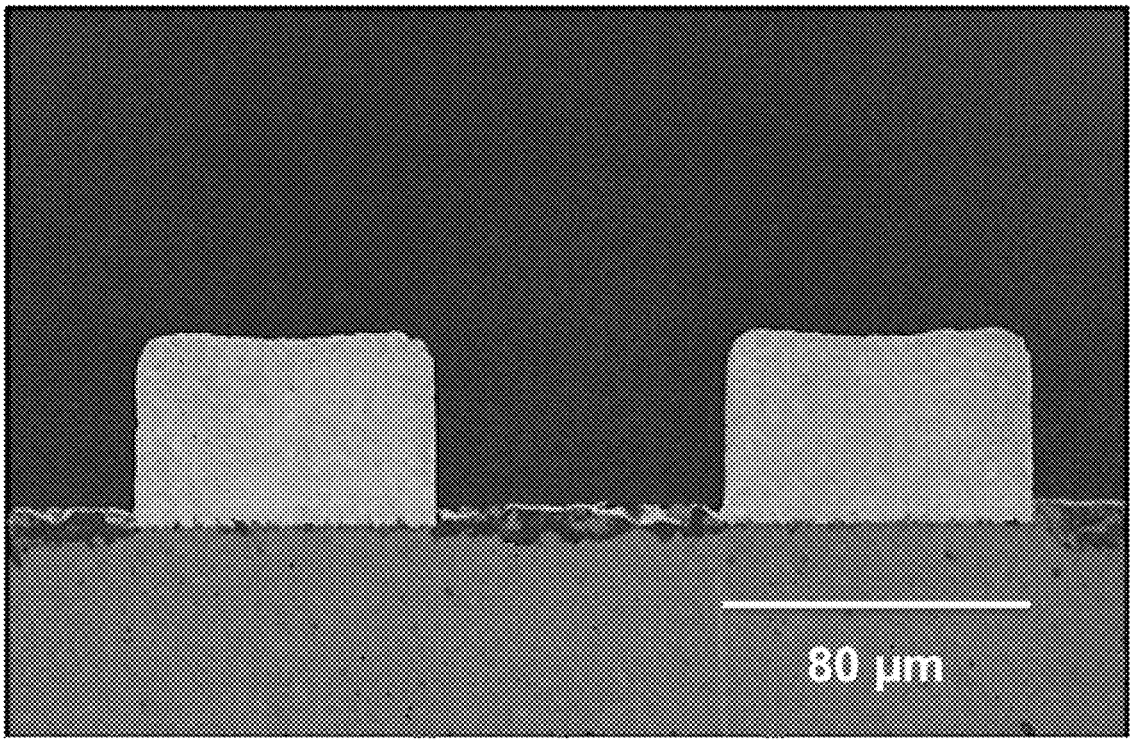
FIG. 9 is an example of plated copper pillar under conditions of Example 1.
Figure 10:
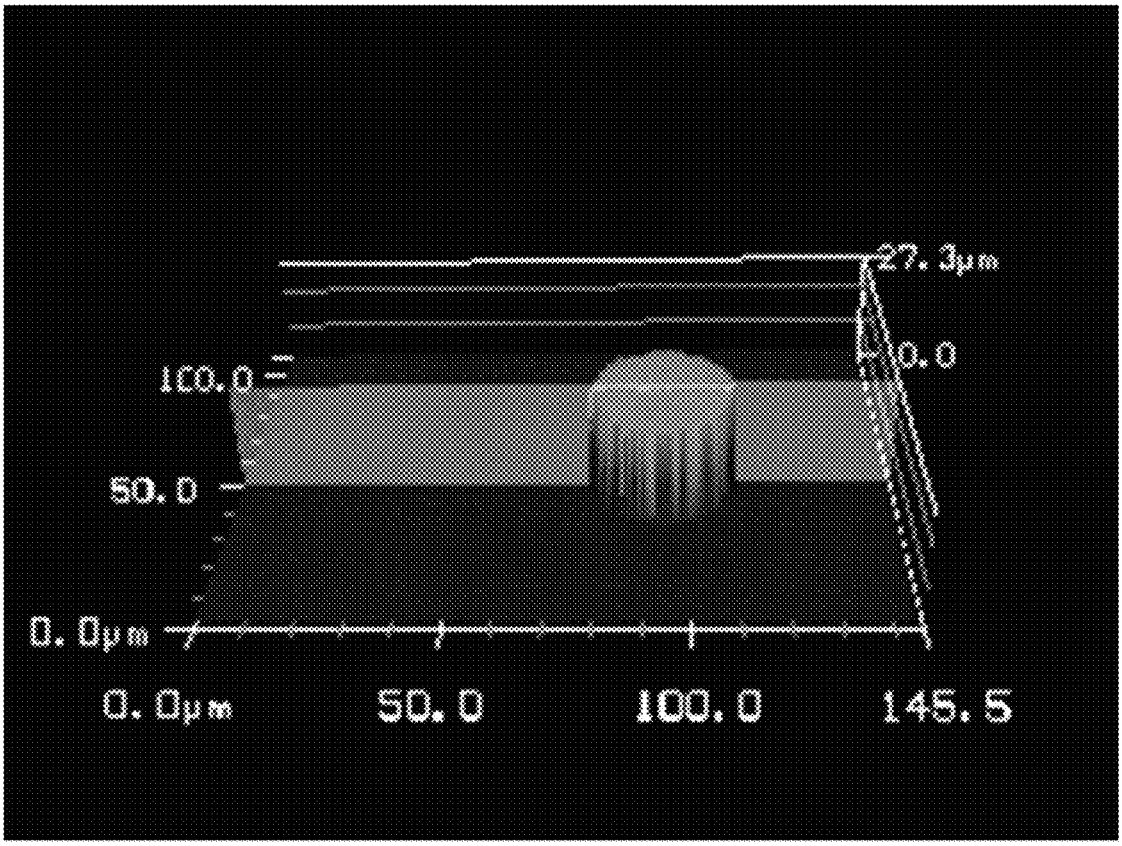
FIG. 10 is an example of plated micro bump under conditions of Example 1.
Figure 11:
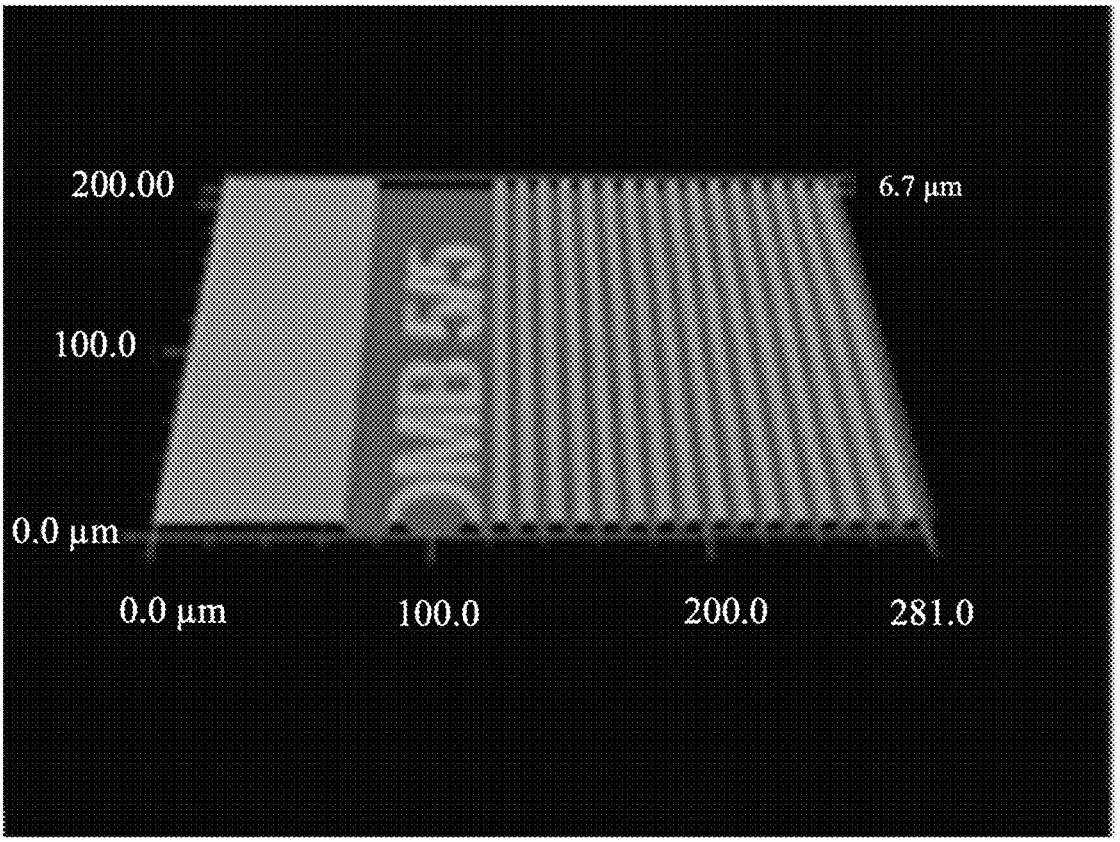
FIG. 11 is an example of plated RDL (Redistribution Layer) under conditions of Example 1.
Figure 12:
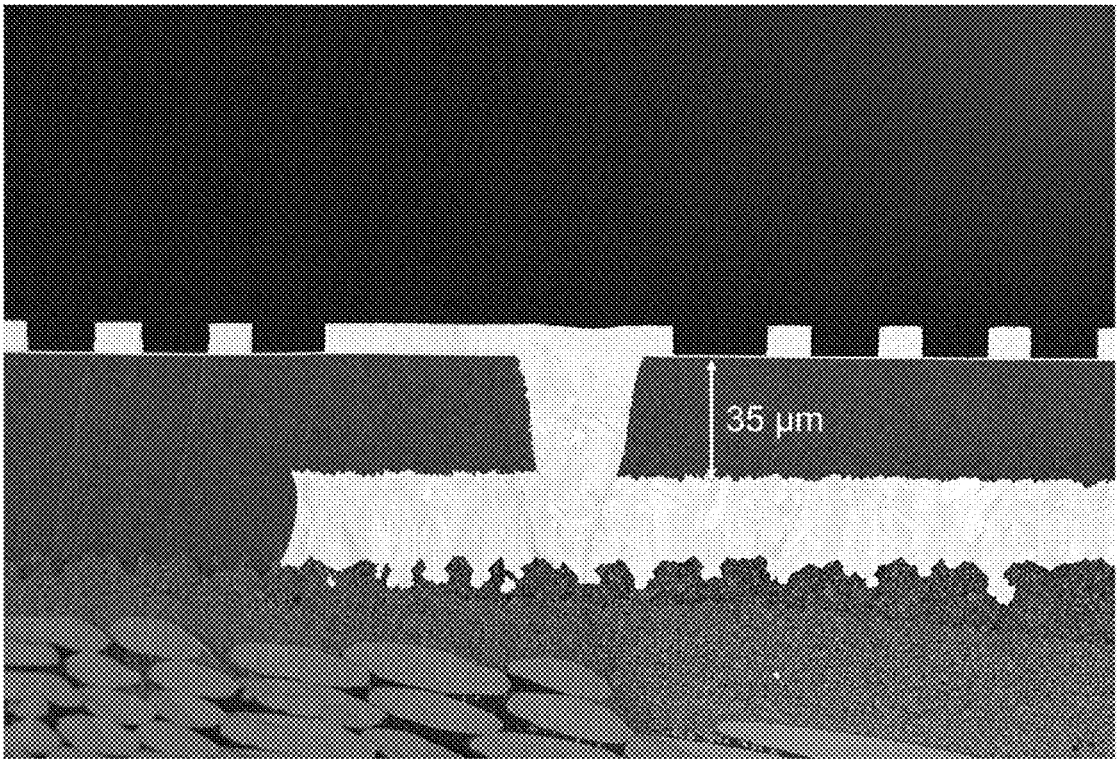
FIG. 12 is an example of plating via +RDL under conditions of Example 1.

The electroplating method of Example 1 can be used to electroplate copper pillars, micro bumps, copper redistribution layer, and copper via plus redistribution layer FIG. 9 is an example of plated copper pillar under conditions of Example 1. FIG. 10 is an example of plated micro bump under conditions of Example 1. FIG. 11 is an example of plated RDL under conditions of Example 1. FIG. 12 is an example of plating via +RDL under conditions of Example 1.

Comparative Examples 1-3

Electroplating was conducted under the same conditions as Example 1 except that the suppressor, the accelerator, and/or the leveler were different. The details and results are shown in Table 6.

TABLE 6

| | Additives | | | Grain size (nm) | Resistivity (μOhm · cm) | Hardness (HV.01) |
|---|---|---|---|---|---|---|
| Example 1 | S1 | A1 | L1 | 107 | 1.78 | 207 |
| Comparative Example 1 | S2 | A1 | L1 | 550 | 2.10 | 187 |
| Comparative Example 2 | S1 | A1 | L7 | 1050 | 1.92 | 167 |
| Comparative Example 3 | S2 | A1 | L8 | 2034 | 2.01 | 117 |

Figure 6:
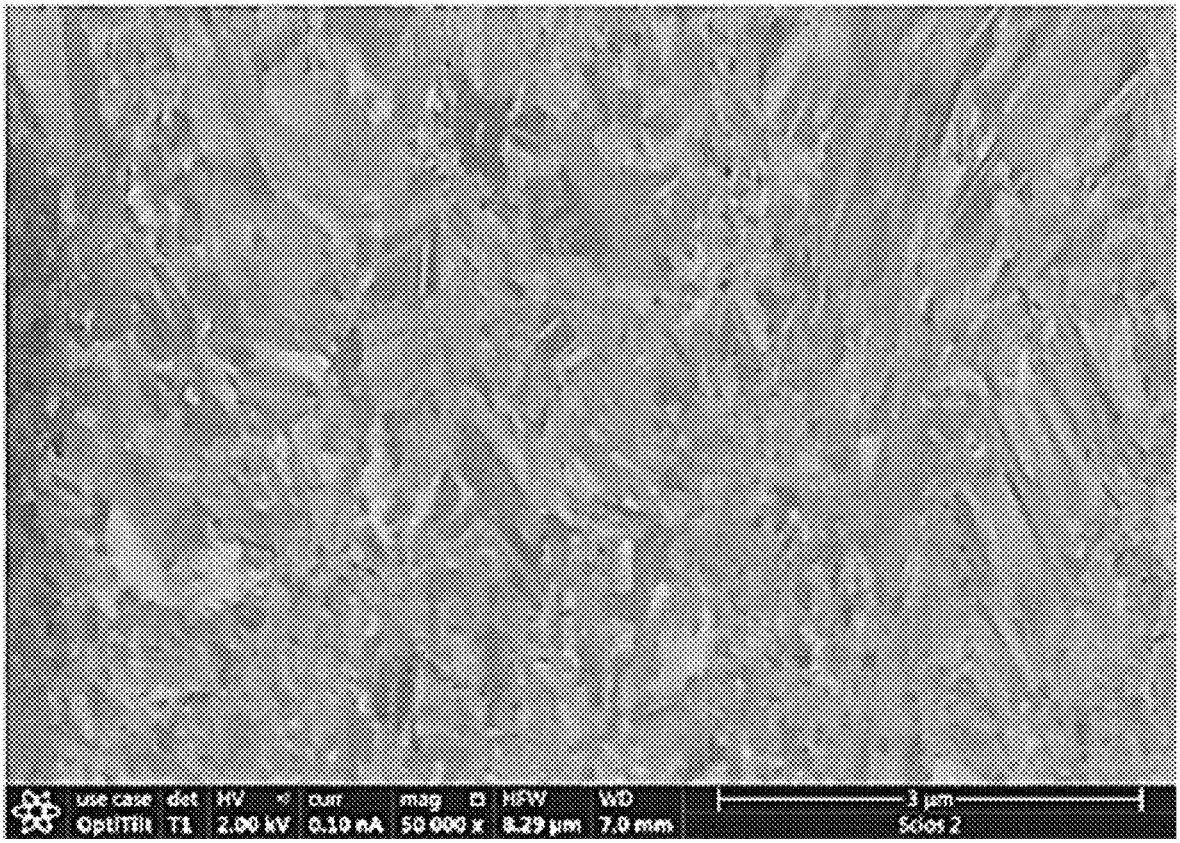
FIG. 6 shows the microstructure of the electroplated copper of comparative Example 1 after electroplating at 5 A/dm$^2$: cross-sectional SEM photo.
Figure 7:
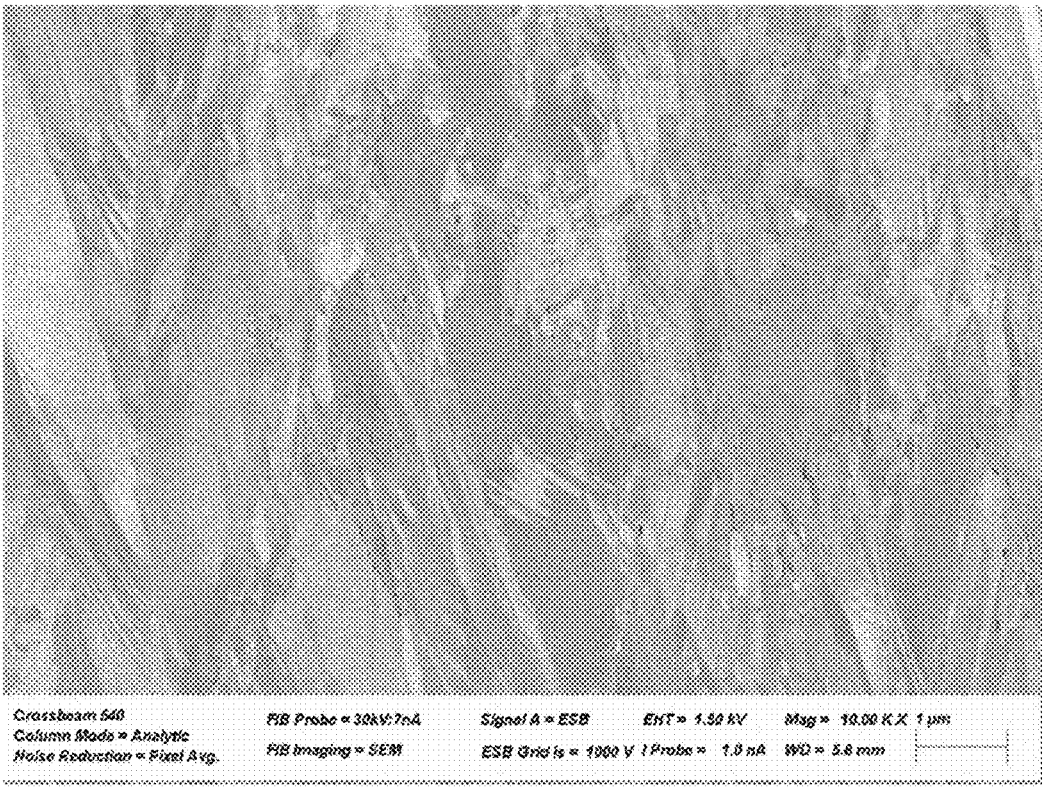
FIG. 7 shows the microstructure of the electroplated copper of Comparative Example 2 after electroplating at 5 A/dm$^2$: (a) cross-sectional SEM photo and (b) EBSD photo.
Figure 7:
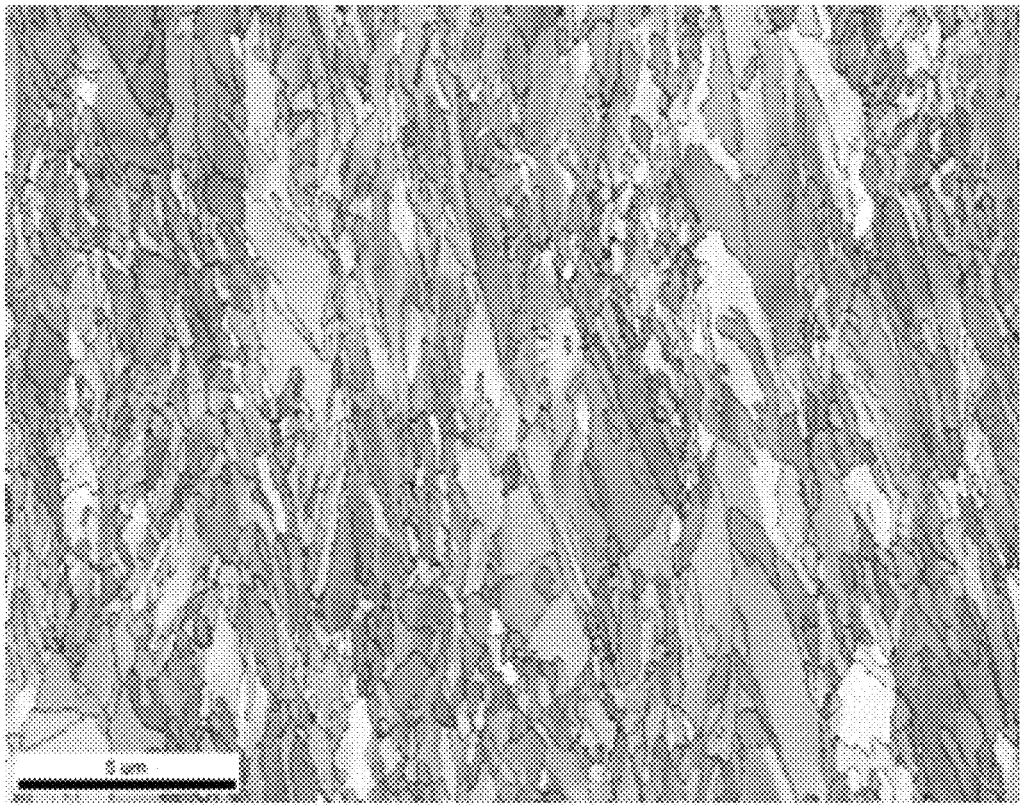
Figure 8:
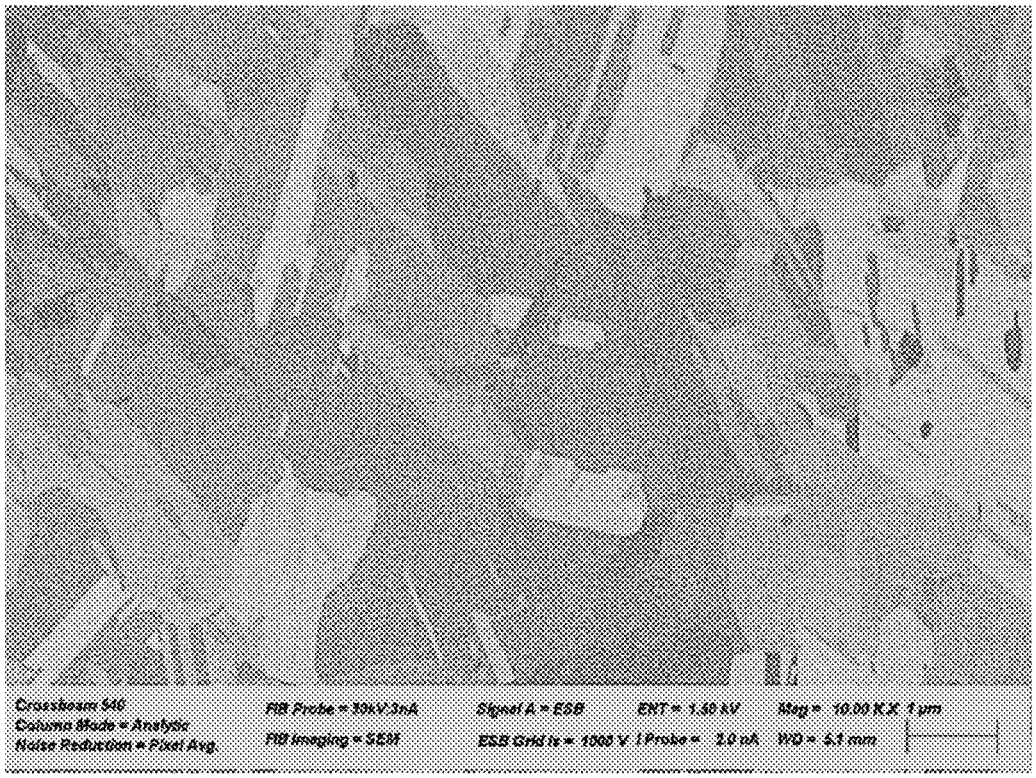
FIG. 8 shows the microstructure of the electroplated copper of Comparative Example 3 after electroplating at 5 A/dm$^2$: (a) cross-sectional SEM photo and (b) EBSD photo.
Figure 8:
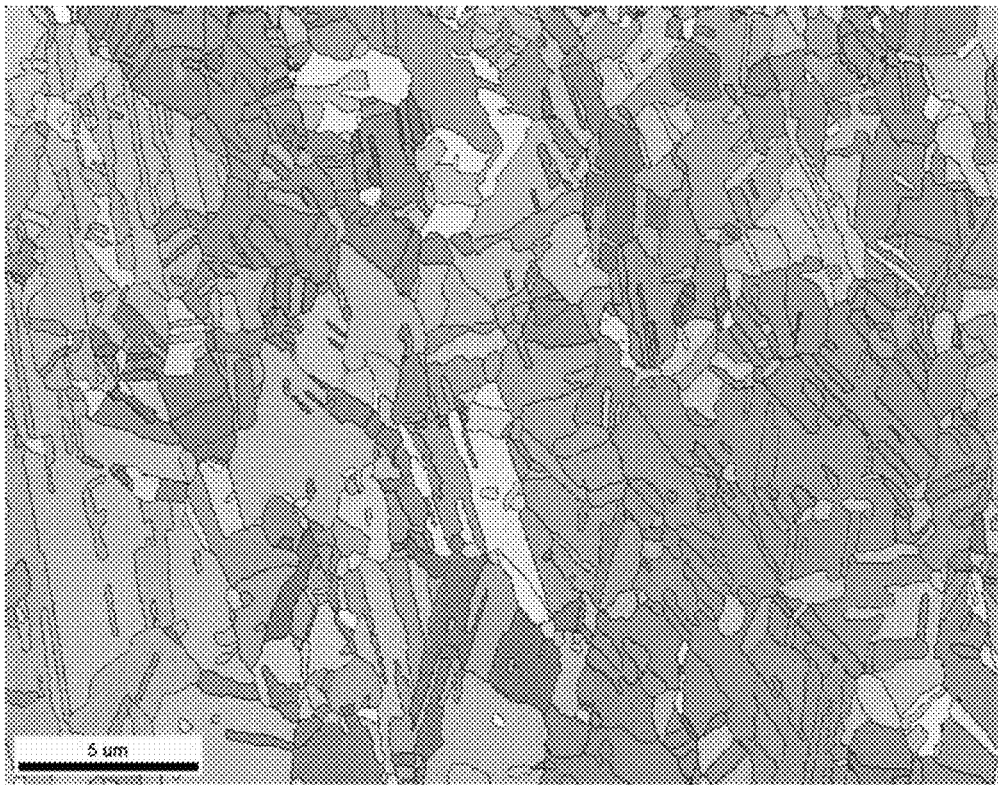

The cross-sectional SEM photo of the electroplated copper of Comparative Example 1 (electroplating at 5 A/dm$^2$) is shown in FIG. 6. The cross-sectional SEM photo and of EBSD photo of the electroplated copper of Comparative Example 2 (electroplating at 5 A/dm$^2$) are shown in FIG. 7. The cross-sectional SEM photo and of EBSD photo of the electroplated copper of Comparative Example 3 (electroplating at 5 A/dm$^2$) are shown in FIG. 8.

S2: polyoxyalkylene glycol (molecular weight about 2,000).

L7

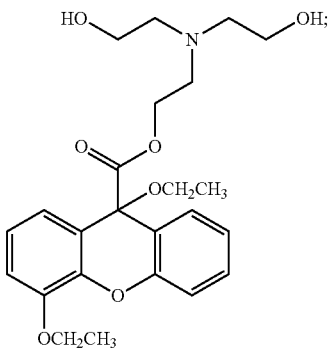

-continued

L8

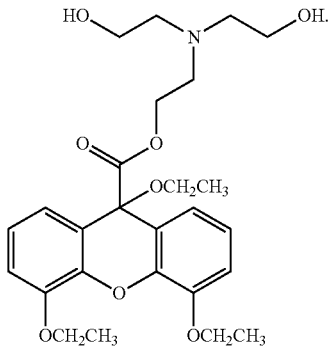

The copper obtained in Comparative Examples 1-3 (after being annealed at 120° C. for 2 hour) has much larger grain size than the copper of the Examples 1-8 (after being annealed at 120° C. for 2 hours). After being annealed at 200° C. for 1 hour, the copper obtained in Comparative Examples 1-3 has even larger grain size. These data show that the combination of Suppressor (Si), Accelerator (A1, A2, or A3), and Leveler (L1, L2, L3, L4, L5, or L6) results in nanograined copper, while other combinations do not result in nanograined copper.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of electroplating nanograined copper on a substrate comprising:

providing the substrate, the substrate being a blank wafer;

providing an electroplating bath that includes a copper salt, an acid, a leveler, a chlorine compound, an accelerator, a suppressor, and water; and electroplating the substrate in the electroplating bath to form the nanograined copper at room temperature, wherein the suppressor is a polyether polyol compound, wherein the nanograined copper has an average grain size of about 100 nm, wherein the nanograined copper has a resistivity of about 1.78-1.90 μOhm·cm, wherein the polyether polyol compound (S1) has the following structure:

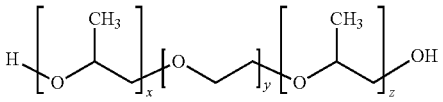

x, y and z are independently an integer of 2-15, and has a molecular weight of about 2,000, wherein the accelerator is bis-(sulfobutyl)-disulfide (A1), (L1)

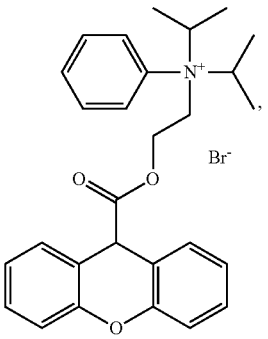

wherein the leveler is wherein the electroplating is at 20 to 22° C., wherein the electroplating is conducted at a current density of 2 A/dm$^2$ or 5 A/dm$^2$, stirring the electroplating bath at an agitation of 200 rpm while electroplating the substrate in the electroplating bath to form the nanograined copper, and wherein the copper salt is copper sulfate and has a $Cu^{2+}$ concentration of 50 g/L; the acid is sulfuric acid and has a concentration of 100 g/L; the chlorine compound is hydrochloride and has a $Cl^-$ concentration of 50 ppm; the accelerator A1 has a concentration of 4 mL/L; and the suppressor S1 has a concentration of 10 mL/L; and the leveler L1 has a concentration of 15 mL/L.

2. The method of claim 1, further comprising:

annealing the nanograined copper at room temperature for 1-7 days, wherein the average grain size of the nanograined copper remains at about 100 nm and the resistivity of the nanograined copper remains at about 1.78-1.90 μOhm·cm.

3. The method of claim 1, further comprising:

annealing the nanograined copper at 100-140° C. for 1-3 hours, wherein the average grain size of the nanograined copper increases to about 700 nm and the resistivity of the nanograined copper remains at about 1.78-1.90 μOhm·cm.

4. The method of claim 1, further comprising:

annealing the nanograined copper at 190-210° C. for 0.5-2 hours, wherein the average grain size of the nanograined copper increases to about 800 nm and the resistivity of the nanograined copper remains at about 1.78-1.90 μOhm·cm.

5. The method of claim 1, wherein electroplating the substrate comprises electroplating micro-bumps.

6. The method of claim 1, wherein electroplating the substrate comprises electroplating RDLs (redistribution layer).

7. The method of claim 1, wherein electroplating the substrate comprises electroplating via plus RDLs.

* * * * *